US006334348B1

(12) United States Patent
Ming-Chih

(10) Patent No.: US 6,334,348 B1
(45) Date of Patent: Jan. 1, 2002

(54) ELECTRONIC LOCK

(75) Inventor: Chen Ming-Chih, Taichung (TW)

(73) Assignee: Summit Automation Co., Ltd., Taichung (TW)

( * ) Notice: Subject to any disclaimer, the term of this patent is extended or adjusted under 35 U.S.C. 154(b) by 0 days.

(21) Appl. No.: 09/431,682

(22) Filed: Nov. 1, 1999

(51) Int. Cl.[7] ..... E05B 13/00

(52) U.S. Cl. ..... 70/472; 70/223; 70/277; 70/422; 292/DIG. 27

(58) Field of Search ..... 70/276, 277, 472, 70/149, 218, 222–224, 422, 279.1; 292/DIG. 27

(56) References Cited

U.S. PATENT DOCUMENTS 1,787,591 A * 1/1931 Ottinger ..... 70/223
3,018,652 A * 1/1962 Dubonnet ..... 70/218
3,748,878 A * 7/1973 Balzano et al. ..... 70/218
4,073,527 A * 2/1978 Schlage ..... 292/347
4,534,194 A * 8/1985 Aydin ..... 70/276 X
4,956,984 A * 9/1990 Chi-Cheng ..... 70/277
5,010,752 A * 4/1991 Lin ..... 70/277
5,040,391 A * 8/1991 Lin ..... 70/277
5,447,047 A * 9/1995 Lin ..... 70/218
5,884,515 A * 3/1999 Milman ..... 70/223 X
5,960,656 A * 10/1999 Yao ..... 70/223 X
5,974,912 A * 11/1999 Cheng et al. ..... 70/223 X
6,158,259 A * 12/2000 Schmitz et al. ..... 70/472 X

* cited by examiner

*Primary Examiner*—Lloyd A. Gall
(74) *Attorney, Agent, or Firm*—W. Wayne Liauh

(57) ABSTRACT

An electronic lock which cannot be easily tampered with by using a strong magnet. It includes: (a) a housing; (b) an electromagnetic element disposed in the housing and provided in the center thereof with a receiving slot and a hole penetrating through the receiving slot; (c) an elastic element disposed in the receiving slot of the electromagnetic element; (d) an actuation block provided with an arresting ring, a protruded pillar which is fitted into the elastic element and the hole of the electromagnetic element; (d) a connection shaft coupled at one end thereof with the actuation block; (e) an action piece mounted on the connection shaft and located outside the actuation block and the electromagnetic element; and (f) a handle having a rotary shaft fastened pivotally with the connection shaft. The action piece is attracted towards the electromagnetic element and abuts against an end of the arresting ring when the electromagnetic element is actuated.

8 Claims, 7 Drawing Sheets

ELECTRONIC LOCK

FIELD OF THE INVENTION

The present invention relates generally to a lock, and more particularly to an electronic lock.

BACKGROUND OF THE INVENTION

As shown in FIGS. 1 and 2, an electronic lock of the prior art comprises a housing 1 which is fastened with a base 2 for containing a lock core 3, a large circular pad 4, a small circular pad 5, a retaining pillar 6, an elastic element 7, and an electromagnetic element 8. A handle shaft 9 is fastened pivotally with the housing 1 for mounting thereon the electromagnetic element 8. The handle shaft 9 is provided in the periphery thereof with a plurality of second engagement projections 91 corresponding to a first engagement projection 61 of the retaining pillar 6. The elastic element 7 is engaged at one end thereof with the second engagement projections 91. The handle shaft 9 is fastened with a handle 10 capable of actuating the handle shaft 9 to turn. The elastic element 7 is received at other end thereof in the center of the first engagement projection 61 of the retaining pillar 6. The retaining pillar 6 is provided at other end thereof with a retaining hole 62 for retaining a retaining projection 31 of the lock core 3. The retaining projection 31 is fitted into the large and the small circular pads 4 and 5. The lock core 3 is provided with a lock tongue 11. When the electromagnetic element 8 is connected with the power source, the small circular pad 5 and the large circular pad 4 are attached to the electromagnetic element 8 such that the retaining pillar 6 is actuated to remain in an action position. In the meantime, the second engagement projection 91 of the handle shaft 9 is completely engaged with the first engagement projection 61 of the retaining pillar 6, whereas the retaining hole 62 of the retaining pillar 6 is coupled with the retaining projection 31 of the lock core 3. As a result, the lock core 3 can be actuated to turn by the handle 10 via the handle shaft 9, the retaining pillar 6 and the retaining projection 31 of the lock core 3.

Such a prior art electronic lock as described above is defective in design in that it can be easily tampered with by an unauthorized person using a magnetic article to bring about an outward displacement of the large and the small circular pads, thereby resulting in the retaining pillar being activated to locate at the action position so as to cause the second engagement projection of the handle shaft to engage the first engagement projection of the retaining pillar. The lock core can be thus turned by the handle to unlock the electronic lock.

As shown in FIG. 3, another prior art electronic lock comprises a dish-shaped clutch magnetic collection seat which is a coil ring 2 mounted on the center shaft of an outer seat disk I for attracting the dish-shaped action piece 3 which is mounted on the actuation retainer 4. The actuation retainer 4 is provided with a retaining seat 5 and is engaged with a receiving seat 6 and a fitting ring 7. Located between the action piece 3 and the coil ring 2 is a spring 8 which is corresponding in location to another spring 9. The retaining seat 5 is fastened pivotally with an outer handle 13 in conjunction with a recessed wheel block 11 and a protruded wheel block 12. A square bolt 14 is joined with the receiving seat 6. When the magnetic action is at work, the action piece 3 forces the spring 8 to become attached to the coil ring 2. In the meantime, the actuation retainer 4 is moved to retain the retaining seat 5 so as to turn the outer handle 13. The motion is imparted to the receiving seat 6 to actuate the square bolt 14 to rotate. As a result, the tongue bolt 15 is unlocked. This prior art electronic lock can be also easily tampered with by an unauthorized person making use of a magnetic object having a greater magnetic force than the electronic lock.

SUMMARY OF THE INVENTION

The primary objective of the present invention is to provide an electronic lock which cannot be easily tampered with by an unauthorized person.

In keeping with the principle of the present invention, the foregoing objective of the present invention is attained by an electronic lock comprising a housing in which an electromagnetic element is disposed. The electromagnetic element is provided with a receiving slot receiving an elastic element which is fitted over a protruded pillar of an actuation block. The actuation block has an arresting ring which is confined to the side of the elastic element. The actuation block is provided with a fitting hole in which the connection shaft of an action piece is received. The action piece is thus located at the outer sides of the electromagnetic element and the actuation block. The connection shaft is provided at other end thereof with a fastening piece for fastening a handle. When the electromagnetic element is connected with the power source, the action piece is attracted to move inwards to urge the actuation block, which is thus forced to move inwards to compress the elastic element. The protruded pillar of the actuation block is then forced into the retaining block of the lock belly so as to control the unlocking of the lock tongue. At this time, the fitting hole of the actuation block is still engaged with the connection shaft. The door can be thus opened by turning the doorknob. When the electromagnetic element is disconnected from the power source, the actuation block is forced by the elastic force of the elastic element to move outward, thereby resulting in the separation of the protruded pillar from the retaining block. The action of the lock tongue thus cannot be controlled. All components of the electronic lock of the present invention must be engaged during the same inward action to unlock the electronic lock. The electronic lock of the present invention cannot be easily tampered with by an unauthorized person using a magnetic object having a magnetic force greater than the magnetic force of the electromagnetic element of the electronic lock.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 2:
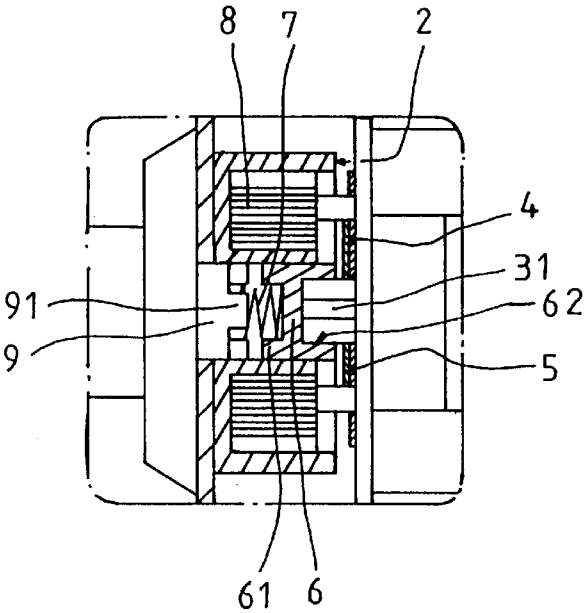
FIG. 2 PRIOR ART
FIG. 2 shows a partial enlarged view of the electronic lock of the prior art as shown in FIG.
Figure 1:
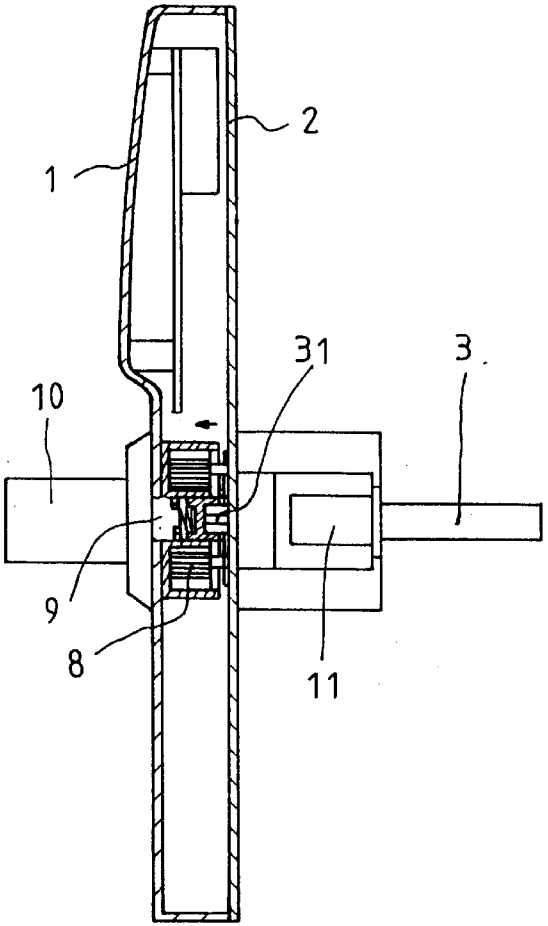
FIG. 1 PRIOR ART
FIG. 1 shows a schematic view of an electronic lock of the prior art.
Figure 3:
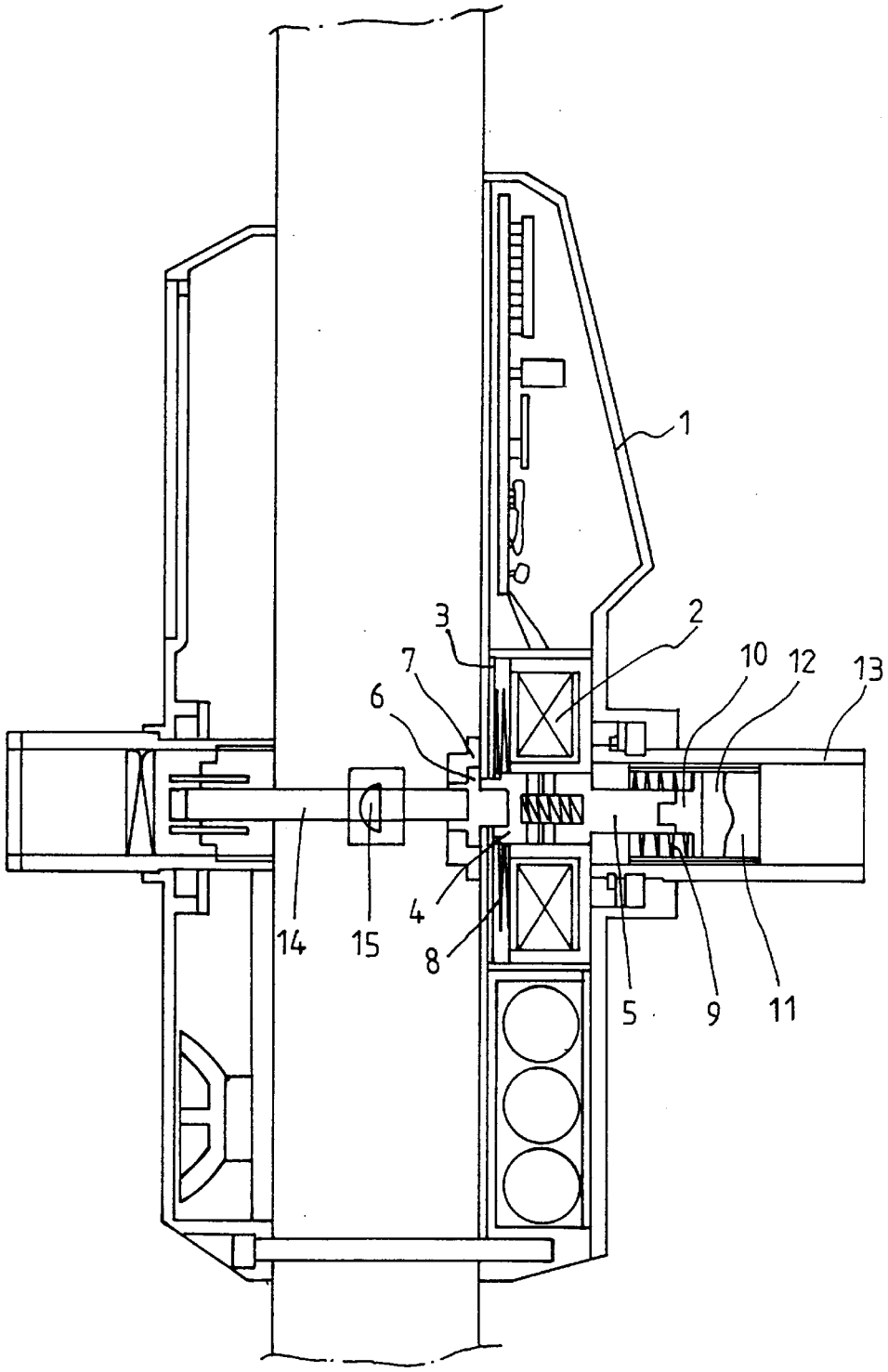
FIG. 3 PRIOR ART
FIG. 3 shows a schematic view of another electronic lock of the prior art.
Figure 4:
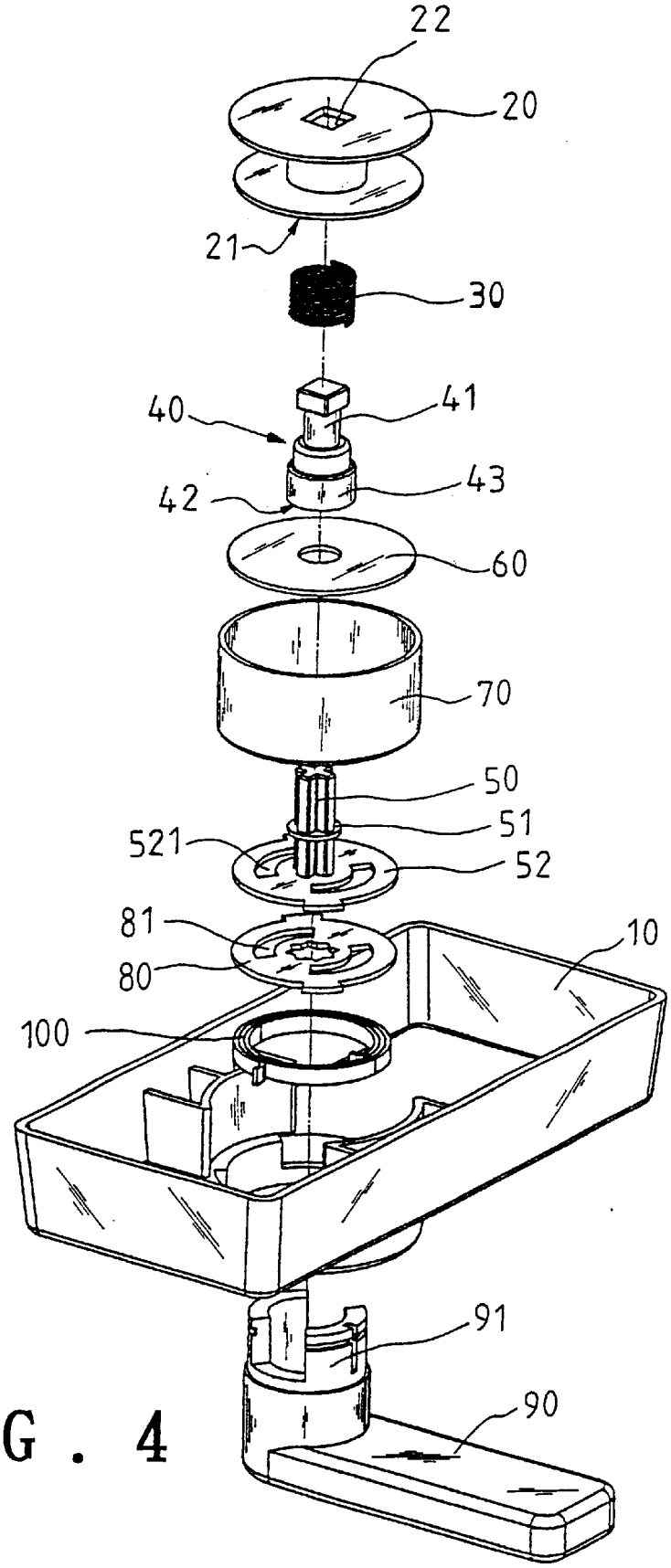
FIG. 4 shows an exploded view of an electronic lock of the present invention.
Figure 5:
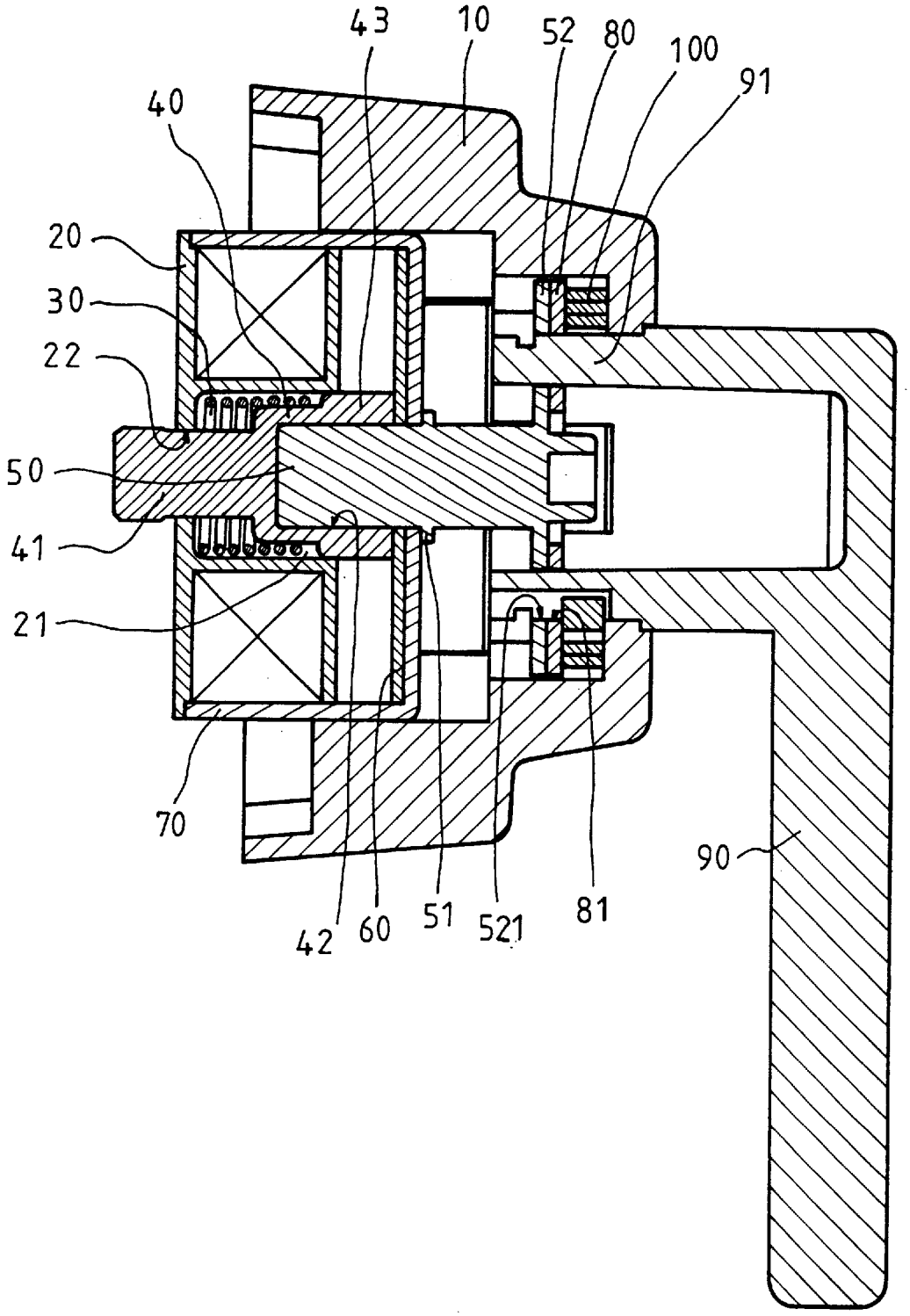
FIG. 5 shows a schematic view of the electronic lock of the present invention in combination.

As shown in FIGS. 4 and 5, an electronic lock embodied in the present invention comprises a housing 10 in which an electromagnetic element is disposed. The electromagnetic element is a coil seat 20 having a coil. The coil seat 20 is provided in the center thereof with a receiving slot 21, and in the side plate thereof with a hole 22 which penetrates through the receiving slot 21. The receiving slot 21 is intended to receive a spring 30. An actuation block 40 is provided with a protruded pillar 41, a fitting hole 42, and an arresting ring 43. The protruded pillar 41 is fitted into the spring 30 and the hole 22 of the coil seat 20 such that the end of the protruded pillar 41 is jutted out of the coil seat 20. A connection shaft 50 is provided with a stopping ring 51 and is used to dispose an action piece 60 and an outer shield 70. The connection shaft 50 is inserted into the fitting hole 42 of the actuation block 40 such that the action piece 60 is located outside the coil seat 20 and the actuation block 40, and that the outer shield 70 contains the coil seat 20, the actuation block 40, and the action piece 60. The connection shaft 50 is further provided with a fastening piece 52 which is provided with a hole 521 corresponding to the hole 81 of a fastening piece 80 fastened with the connection shaft 50. A handle 90 has a rotary shaft 91 which is received in the holes 521 and 81. Located between the inner wall of the housing 10 and the fastening piece 80 is a spring 100 which is fitted over the rotary shaft 91 of the handle 90 to enable the handle 90 to return to its original position.

Figure 6:
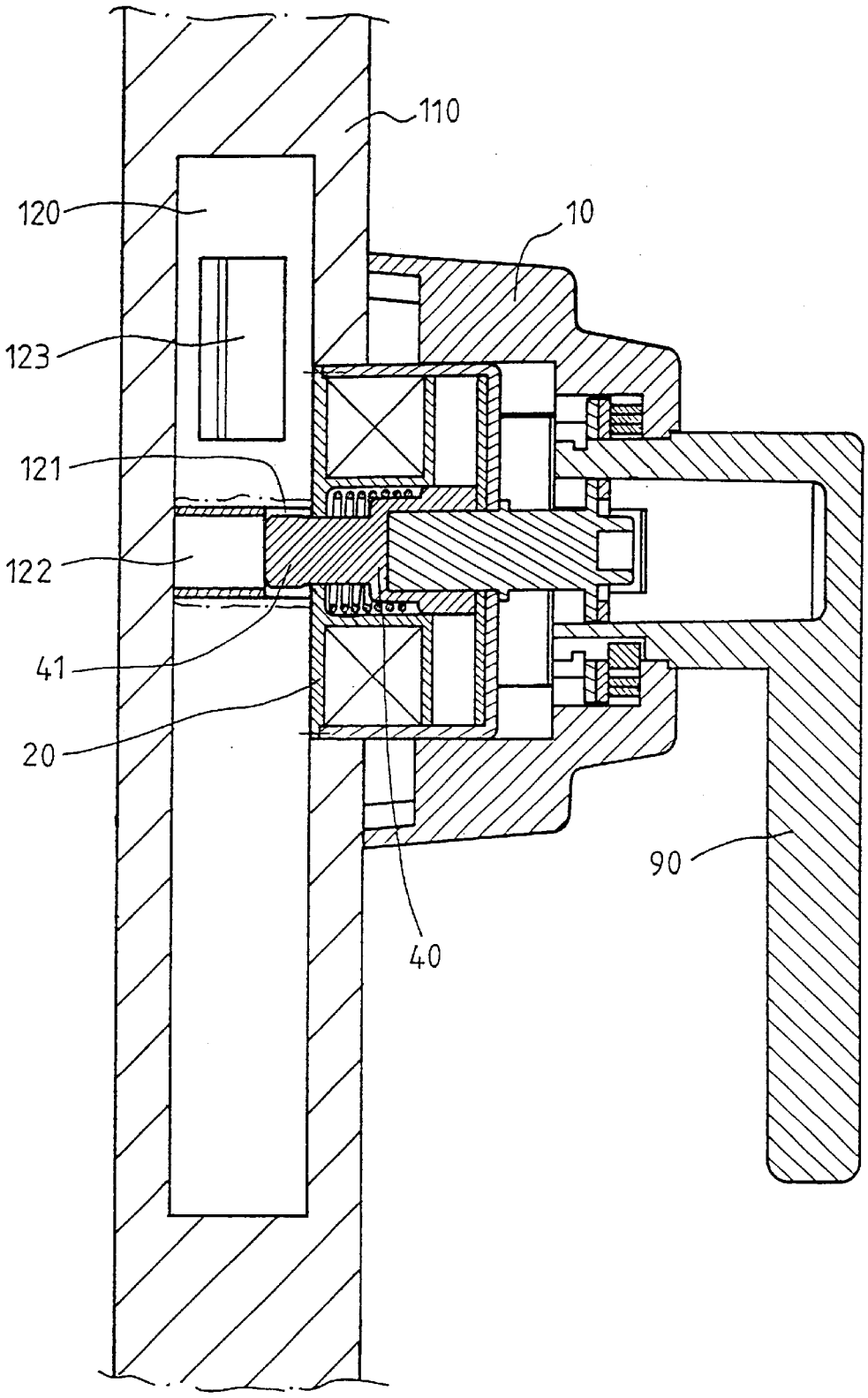
FIG. 6 shows a schematic view of the present invention in conjunction with a lock flank.
Figure 7:
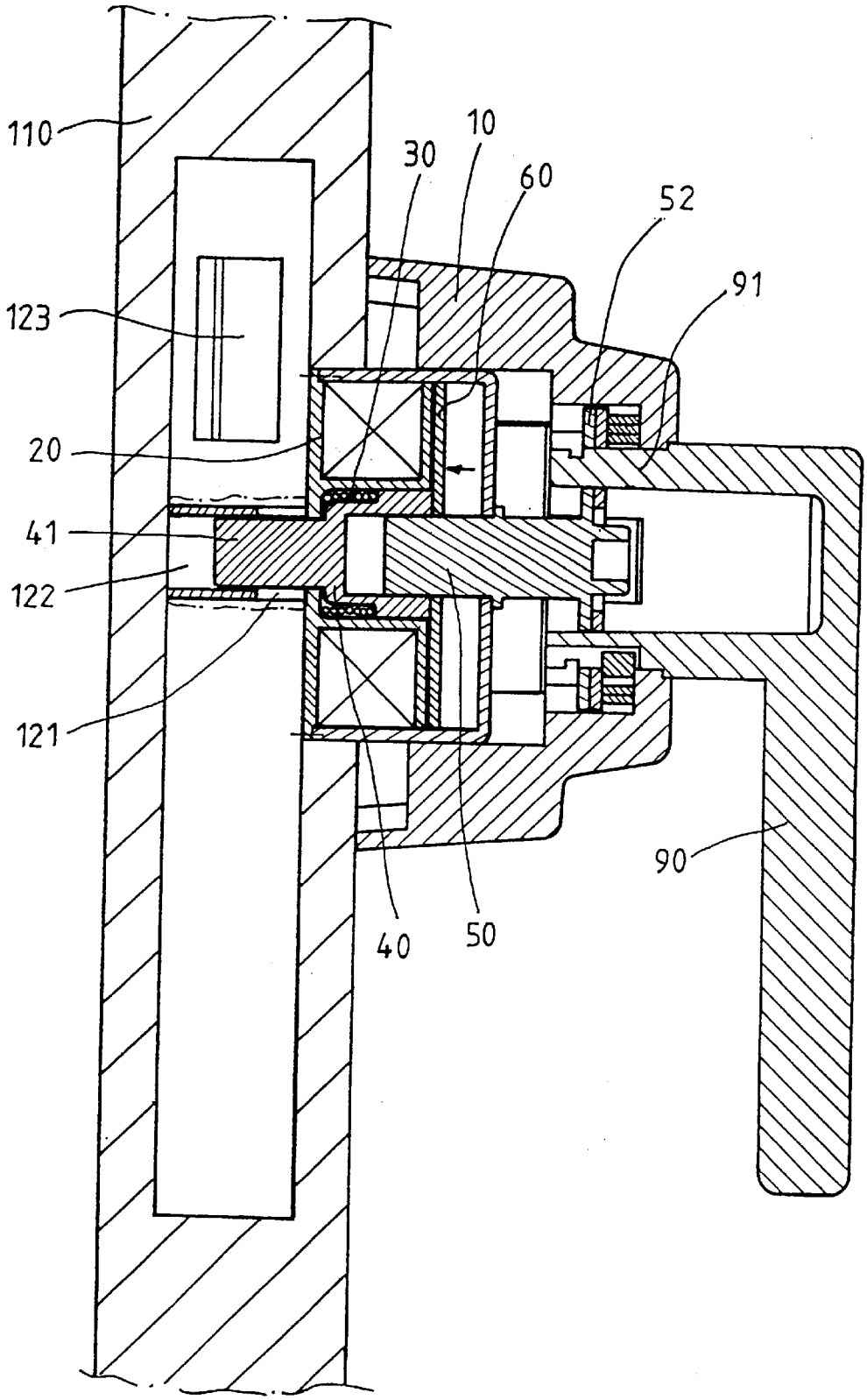
FIG. 7 shows a schematic view of the present invention at work.

As shown in FIG. 6, the electronic lock of the present invention is fastened with a door frame 110 such that the coil seat 20 is fastened with the outer side of a lock flank 120 which is inserted onto the door frame 110, and that the housing 10 is fastened onto the door frame 110, and that the protruded pillar 41 of the actuation block 40 is inserted into a hole 121 of the lock flank 120. The lock flank 120 is provided with a retaining block 122 which is located in the hole 121 for controlling the action of a lock tongue 123. As shown in FIG. 7, when the control circuit is turned on, the coil seat 20 is connected with the power source. As a result, a magnetic force is brought about by the coil seat 20. The action piece 60 is attracted by the magnetic force to move inwards to urge the actuation block 40, thereby causing the arresting ring 43 of the actuation block 40 to compress the spring 30. The protruded pillar 41 is thus displaced to enter the retaining block 122 of the lock flank 120. In the meantime, the connection shaft 50 remains in the fitting hole 42 of the actuation block 40. As the handle 90 is turned, the rotary shaft 91 of the handle 90 actuates the fastening piece 52 and the connection shaft 50 to turn. The motion is imparted to the actuation block 40. As the actuation block 40 turns, the protruded pillar 41 of the actuation block 40 actuates the retaining block 122 of the lock flank 120 to turn, so as to control the action of the lock tongue 123 to enable the door frame 110 to be opened.

Figure 8:
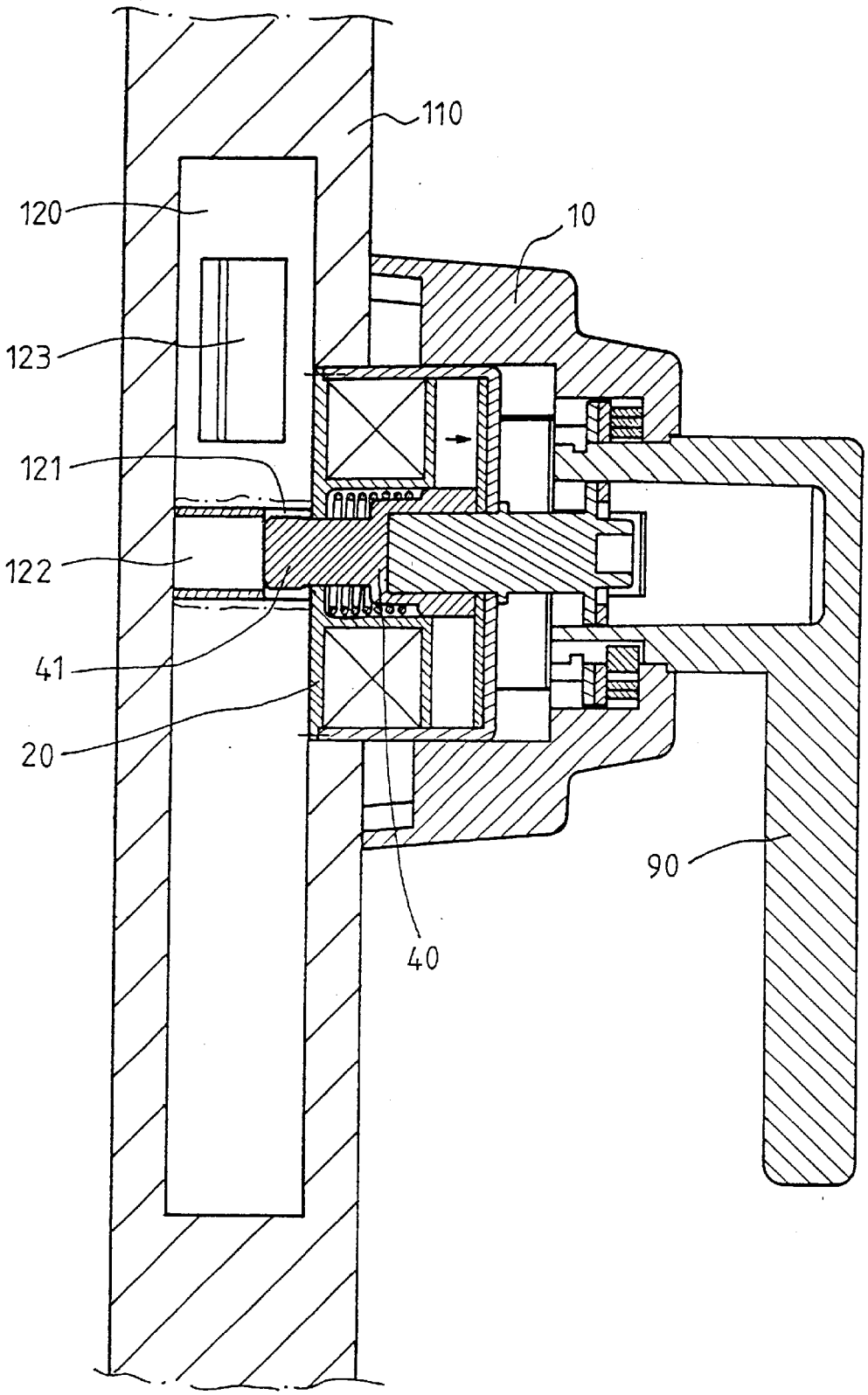
FIG. 8 shows another schematic view of the present invention at work.

As shown in FIG. 8, as soon as the coil seat 20 is disconnected with the power source, the actuation block 40 is forced by the elastic force of the decompressed spring 30 to displace rearward, thereby resulting in the disengagement of the protruded pillar 41 of the actuation block 40 with the retaining block 122 of the lock flank 120. As a result, the action piece 60 moves backward to return to its original position.

The embodiment of the present invention described above is to be regarded in all respects as being merely illustrative and not restrictive. Accordingly, the present invention maybe embodied in other specific forms without deviating from the spirit thereof. The present invention is therefore to be limited only by the scopes of the following appended claims.

What is claimed is:

1. An electronic lock comprising:

a housing;

an electromagnetic element disposed in said housing and provided in the center thereof with a receiving slot and a hole penetrating through said receiving slot;

an elastic element disposed in said receiving slot of said electromagnetic element;

an actuation block provided with an arresting ring, a protruded pillar which is fitted into said elastic element and said hole of said electromagnetic element;

a connection shaft coupled at one end thereof with said actuation block;

an action piece mounted on said connection shaft and located outside said actuation block and said electromagnetic element, said action piece being attracted towards said electromagnetic element and abutting against an end of said arresting ring when said electromagnetic element is actuated; and a handle having a rotary shaft fastened pivotally with said connection shaft.

2. The electronic lock as defined in claim 1, wherein said electromagnetic element is a coil seat having a coil.

3. The electronic lock as defined in claim 1, wherein said elastic element is a spring.

4. The electronic lock as defined in claim 1, wherein said actuation block is provided with a fitting hole for engaging one end of said connection shaft.

5. The electronic lock as defined in claim 1, wherein said connection shaft is provided with a fastening piece which is provided with a hole for engaging said rotary shaft of said handle.

6. The electronic lock as defined in claim 1 further comprising an outer shield fitted over said connection shaft.

7. The electronic lock as defined in claim 1, wherein said connection shaft is provided with a stopping ring for confining said action piece.

8. The electronic lock as defined in claim 1, wherein said housing is further provided therein with a second elastic element which is located between the inner wall of said housing and a fastening piece such that said second elastic element is fitted over said rotary shaft of said handle.

* * * * *